US011445799B2

(12) United States Patent
Liu

(10) Patent No.: US 11,445,799 B2
(45) Date of Patent: Sep. 20, 2022

(54) COSMETIC CONTAINER WITH LIPSTICK REPLACEMENT DEVICE

(71) Applicant: Ting Nan Liu, New Taipei (TW)

(72) Inventor: Ting Nan Liu, New Taipei (TW)

(73) Assignee: Zhuhai Ding Rong Plastic Products Co., LTD, Zhuhai (CN)

( * ) Notice: Subject to any disclaimer, the term of this patent is extended or adjusted under 35 U.S.C. 154(b) by 387 days.

(21) Appl. No.: 16/807,376

(22) Filed: Mar. 3, 2020

(65) Prior Publication Data

US 2021/0274910 A1 Sep. 9, 2021

(51) Int. Cl.
*A45D 40/06* (2006.01)
*A45D 40/00* (2006.01)

(52) U.S. Cl.
CPC ..... *A45D 40/06* (2013.01); *A45D 2040/0056* (2013.01)

(58) Field of Classification Search
CPC .... A45D 2040/0025; A45D 2040/0031; A45D 2040/0037; A45D 2040/0043; A45D 2040/005; A45D 2040/0056; A45D 40/06
See application file for complete search history.

(56) References Cited

U.S. PATENT DOCUMENTS

| | | | | |
|---|---|---|---|---|
| 3,146,881 | A * | 9/1964 | Metreaud | A45D 40/16 401/86 |
| 5,988,917 | A * | 11/1999 | Sheffler | A45D 40/06 401/78 |
| 10,881,184 | B1 * | 1/2021 | Yan | A45D 40/06 |
| 11,033,091 | B2 * | 6/2021 | Wiesenthal | A45D 40/065 |
| 11,330,890 | B2 * | 5/2022 | Trochel | A45D 40/06 |
| 2019/0328109 | A1 * | 10/2019 | Lin | A45D 33/006 |
| 2020/0288845 | A1 * | 9/2020 | Maurin | A45D 40/04 |
| 2021/0076802 | A1 * | 3/2021 | Liu | A45D 40/06 |

* cited by examiner

*Primary Examiner* — Patrick M. Buechner

(57) ABSTRACT

A cosmetic container includes a base including an inner cavity and at least one positioning member on a wall of the inner cavity; a support frame including an axial channel, at least one latch at an end, and at least one complementary positioning member each disposed between the end of the support frame and a portion of each latch and configured to mate in snap-fit engagement with the positioning member; a lipstick carrier including a rotational member at an end, an outer shell, and an inner shell secured to the rotational member and slidably disposed in the outer shell, and an axial space in the inner shell wherein the lipstick carrier is mounted through the support frame and an open end of the rotational member is held in position in the base; and a cap releasably secured to the support frame for covering the lipstick carrier.

5 Claims, 6 Drawing Sheets

COSMETIC CONTAINER WITH LIPSTICK REPLACEMENT DEVICE

BACKGROUND OF THE INVENTION

1. Field of the Invention

The invention relates to cosmetic containers and more particularly to a cosmetic container having assemblable components and a lipstick replacement device so that a consumed lipstick can be replaced with a new one for the purpose of reusing the cosmetic container.

2. Description of Related Art

Lipstick is a cosmetic product that applies color, texture, and protection to the lips. In use, a person may open a cap, rotate a lipstick carrier to expose a lipstick, and apply the lipstick to the lips. After use, the person may put the cap on the lipstick again.

However, the conventional lipsticks are disposed after the lipstick is consumed. This may cause pollution and does not protect the natural environment.

Thus, the need for improvement still exists.

SUMMARY OF THE INVENTION

The invention has been made in an effort to solve the problems of the conventional art including being disposed after a lipstick is consumed by providing a cosmetic container with a lipstick replacement device having novel and nonobvious characteristics including reusability.

To achieve above and other objects of the invention, the invention provides a cosmetic container comprising a base including an inner cavity and at least one positioning member on a wall of the inner cavity; a support frame including an axial channel, at least one latch extending out of a first end, and at least one complementary positioning member each disposed between the first end of the support frame and a portion of each of the at least one latch and configured to mate in snap-fit engagement with the positioning member; a lipstick carrier including a rotational member at a first end, an outer shell, and an inner shell secured to the rotational member and slidably disposed in the outer shell, and an axial space in the inner shell wherein the lipstick carrier is mounted through the support frame and an open end of the rotational member is held in position in the base; and a cap releasably secured to the support frame for covering the lipstick carrier in a non-use state.

The invention has the following advantages and benefits in comparison with the conventional art: when the lipstick is consumed, a user may remove the cap. Next, the user may use one hand to hold the base and the other hand to hold the support frame. Next, the user may rotate the base to detach the base. Next, the user may hold the support frame firmly in the hand and push the lipstick carrier to disengage the support frame from the lipstick carrier. The user may mount a new lipstick carrier on the support frame. Therefore, the components of the cosmetic container including the base, the cap and the support frame can be reused, and the component of the cosmetic container such as the lipstick carrier can be recycled all for the protection of the natural environment.

The above and other objects, features and advantages of the invention will become apparent from the following detailed description taken with the accompanying drawings.

DETAILED DESCRIPTION OF THE INVENTION

Figure 1:
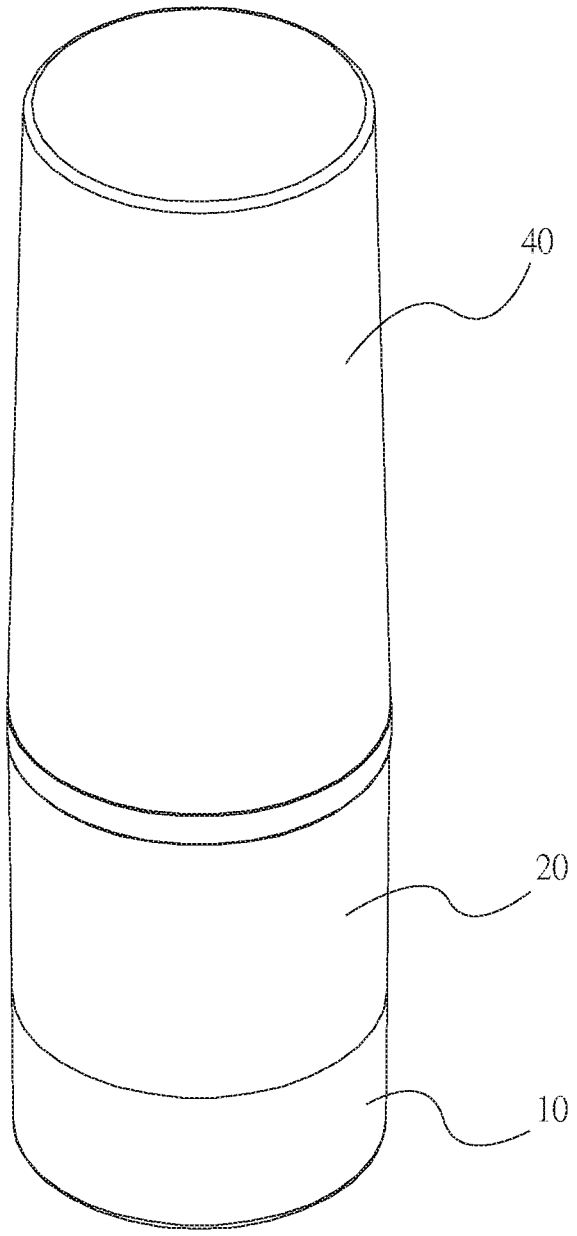
FIG. 1 is a perspective view of a cosmetic container according to the invention.

Referring to FIGS. 1 to 7, a cosmetic container in accordance with the invention is cylindrical and comprises a base 10, a support frame 20, a lipstick carrier 30 and a cap 40 as discussed in detail below.

The base 10 includes an inner cavity 11, two opposite projections 12 on a wall of the inner cavity 11, and a cross-shaped protrusion 13 on a central portion of the inner cavity 11. The support frame 20 has two open ends and includes an axial channel 21, two opposite curved latches 22 extending out of one end, two recesses 23 each disposed between one end of the support frame 20 and one portion of the latch 22 and being complementary to the projection 12, and a plurality of protuberances 24 disposed around the other end of the support frame 20.

Figure 2:
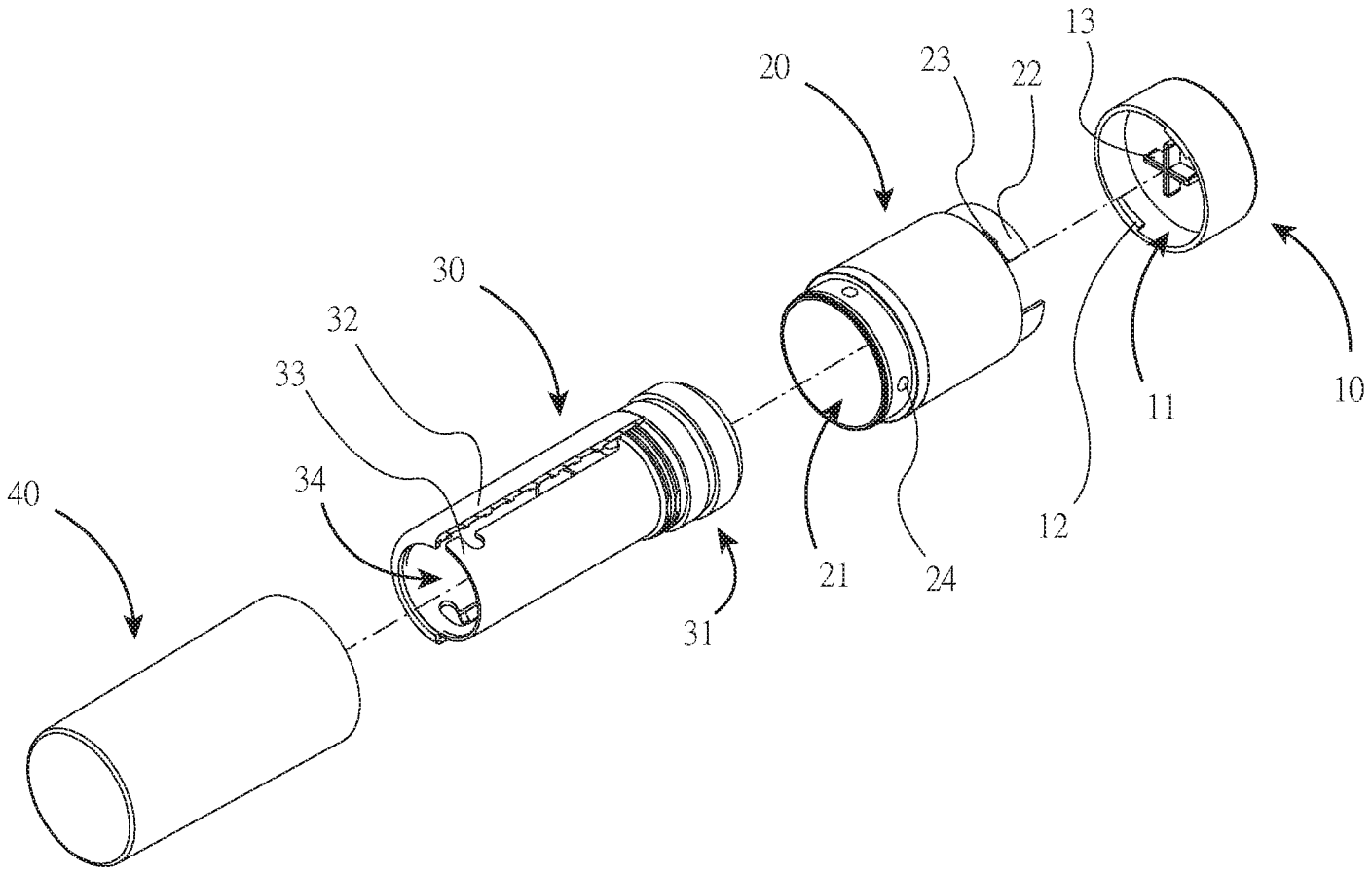
FIG. 2 is an exploded view of the cosmetic container.

The lipstick carrier 30 includes a rotational member 31 at one end, an outer shell 32 and an inner shell 33 integrally formed with the rotational member 31 and slidably disposed in the outer shell 32. As shown in FIG. 2 specifically, the outer shell 32 is removed to expose the inner shell 33.

The lipstick carrier 30 further comprises a tunnel 35 through the rotational member 31, an annular toothed groove 36 disposed on an inner surface of the tunnel 35 and being configured to position the cross-shaped protrusion 13, and an axial space 34 in the inner shell 33. The lipstick carrier 30 is mounted through the support frame 20 and an open end of the rotational member 31 is held in position in the base 10. The cap 40 includes an inner groove 41 disposed at one end and configured to releasably secure to the protuberances 24 so that the cap 40 and the support frame 20 are fastened together with the lipstick carrier 30 being covered in a non-use state.

Preferably, the base 10, the support frame 20, the lipstick carrier 30 and the cap 40 are formed of polyethylene terephthalate (PET) which is a recyclable material for protecting the natural environment. Thus, the base 10, the support frame 20, the lipstick carrier 30 and the cap 40 all can be used again after they have been treated using a special industrial process.

Figure 3:
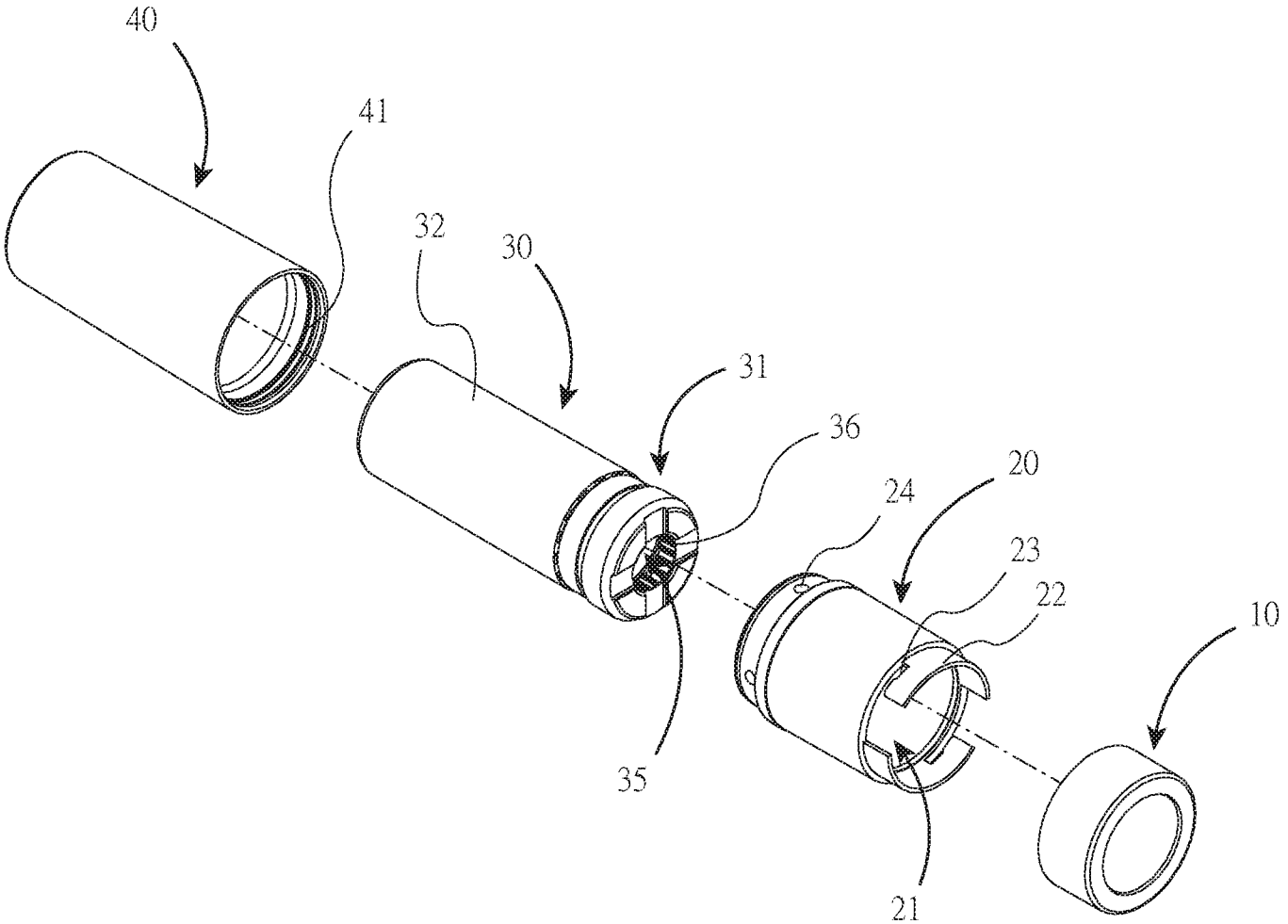
FIG. 3 is another exploded view of the cosmetic container.
Figure 4:
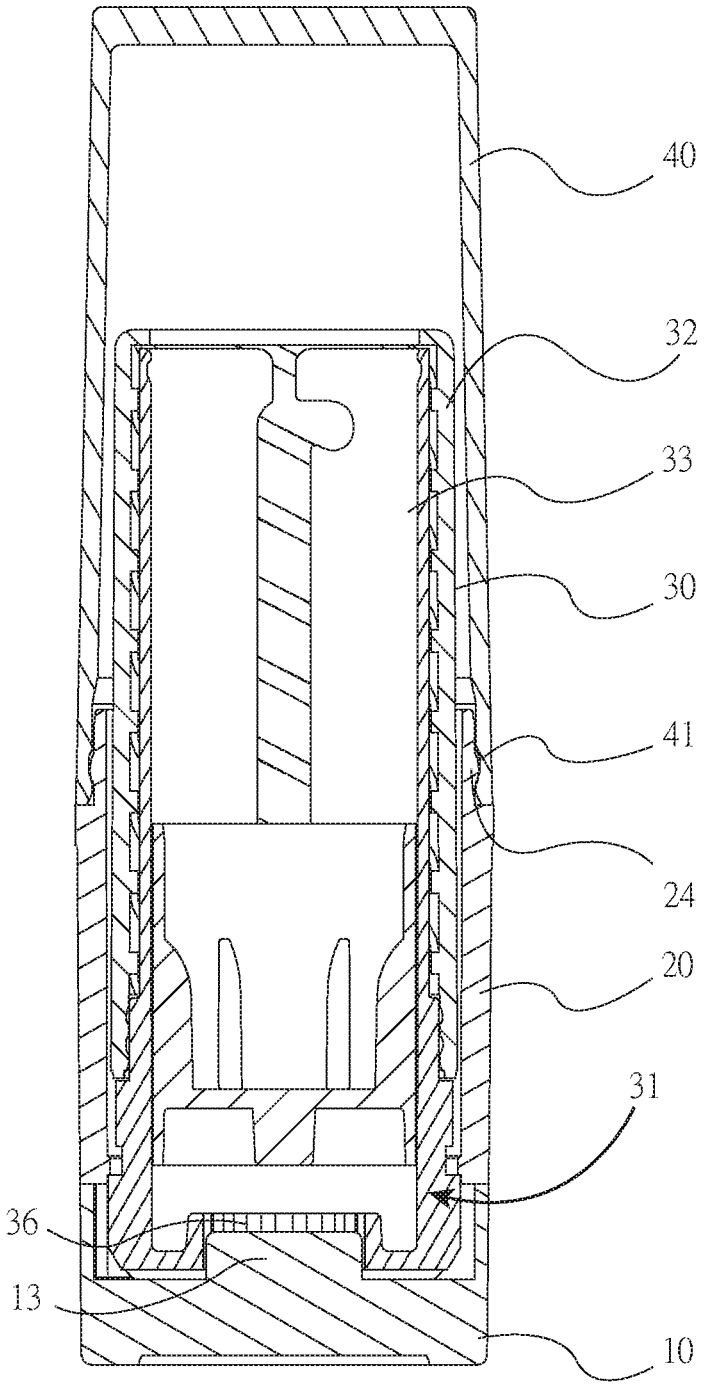
FIG. 4 is a longitudinal sectional view of the cosmetic container.
Figure 6:
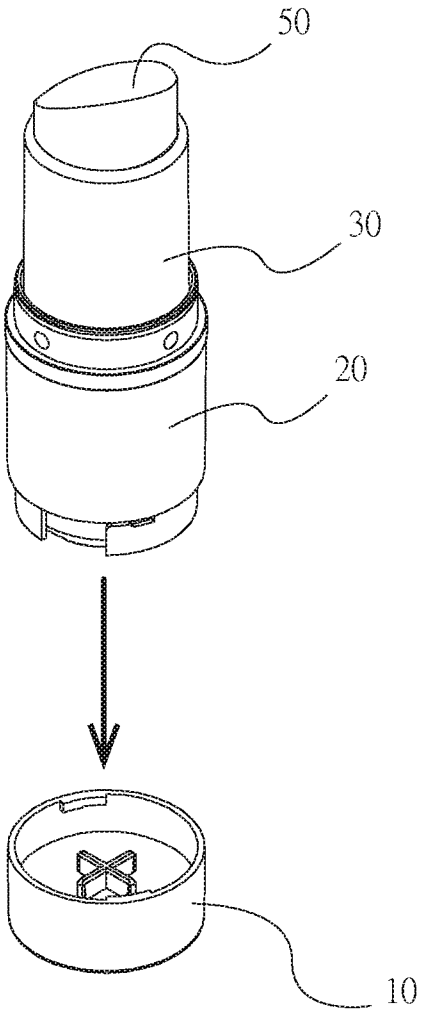
FIG. 6 is an exploded perspective view of the cosmetic container with the cap removed and the base disengaged from both the support frame and the lipstick carrier.
Figure 5:
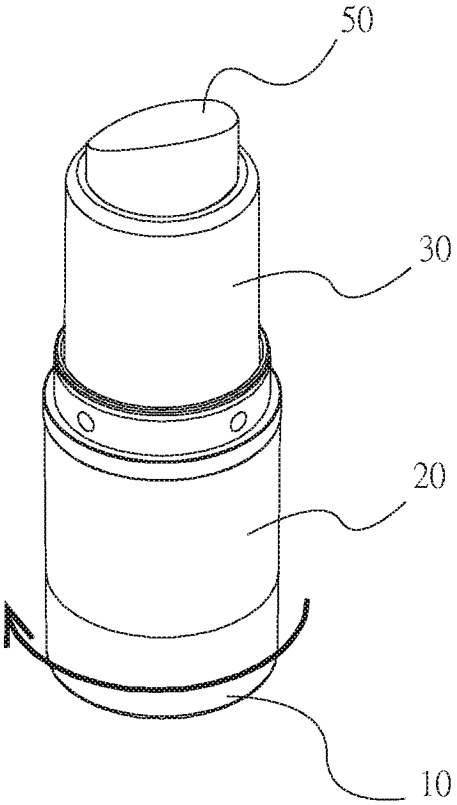
FIG. 5 is a perspective view of the cosmetic container with the cap removed.
Figure 7:
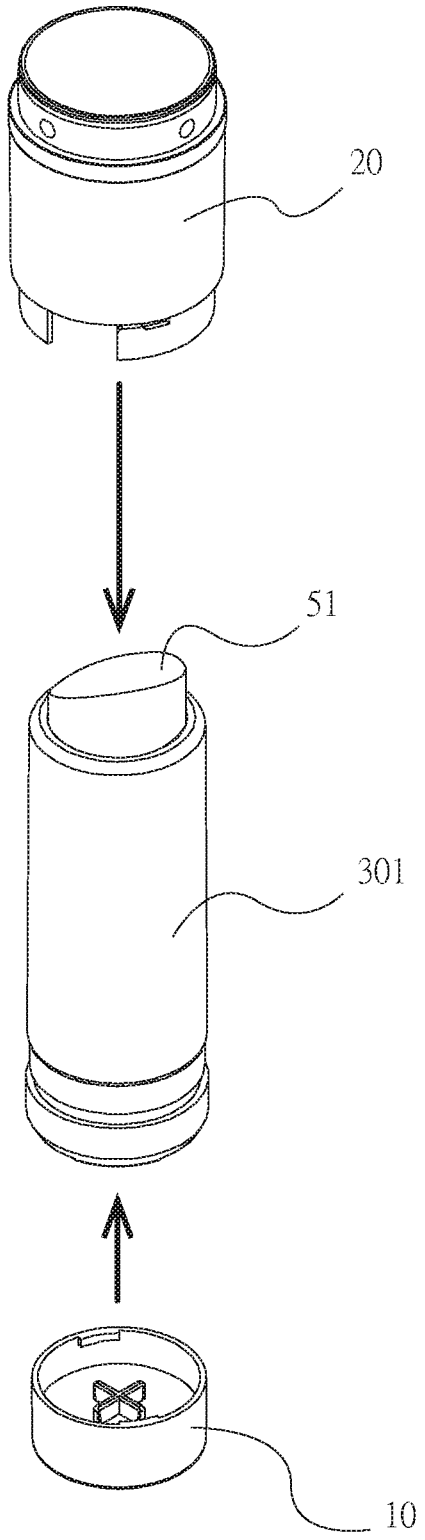
FIG. 7 is an exploded perspective view of the cosmetic container with the cap removed and the base, the support frame and the lipstick carrier separated.

As shown in FIGS. 5, 6 and 7 specifically, an operation of replacing the lipstick carrier 30 with a new lipstick carrier 301 is described below in conjunction with FIGS. 2, 3 and 4. First, when a lipstick 50 is consumed, a user may remove the cap 40. Next, the user may use one hand to hold the base 10 and the other hand to hold the support frame 20. Next, the user may rotate the base 10 to detach the base 10. Next, the user may hold the support frame 20 firmly in the hand and push the lipstick carrier 30 toward the latches 22 to disengage the support frame 20 from the lipstick carrier 30. The user may mount the new lipstick carrier 301 on the latches 22 of the support frame 20 in which the lipstick carrier 301 has a new lipstick 51. Finally, the user may join the base 10, the cap 40, and the already assembled support frame 20 and the lipstick carrier 301 to make a cosmetic container.

It is envisaged by the invention that the components of the cosmetic container including the base 10, the cap 40 and the support frame 20 can be reused, and the component of the cosmetic container such as the lipstick carrier 30 can be recycled all for the protection of the natural environment.

While the invention has been described in terms of preferred embodiments, those skilled in the art will recognize that the invention can be practiced with modifications within the spirit and scope of the appended claims.

What is claimed is:

1. A cosmetic container, comprising:

a base including an inner cavity and at least one positioning member disposed on a wall of the inner cavity;

a support frame including an axial channel, at least one latch extending out of a first end, and at least one complementary positioning member each disposed between the first end of the support frame and a portion of each of the at least one latch and configured to mate in snap-fit engagement with the positioning member;

a lipstick carrier including a rotational member at a first end, an outer shell, and an inner shell secured to the rotational member and slidably disposed in the outer shell, and an axial space in the inner shell wherein the lipstick carrier is mounted through the support frame and an open end of the rotational member is held in position in the base; and a cap releasably secured to the support frame for covering the lipstick carrier in a non-use state.

2. The cosmetic container of claim 1, wherein the lipstick carrier further comprises a tunnel through the rotational member and an annular toothed groove disposed on an inner surface of the tunnel; and wherein the base further comprises a positioning element disposed on the inner cavity and configured to releasably secure to the annular toothed groove.

3. The cosmetic container of claim 1, wherein the support frame further comprises at least one locking member disposed around a second end; and wherein the cap includes an inner groove configured to releasably secure to the at least one locking member.

4. The cosmetic container of claim 1, wherein the base, the support frame, the lipstick carrier, and the cap are formed of polyethylene terephthalate (PET).

5. The cosmetic container of claim 1, wherein the inner shell is integrally formed with the rotational member.

* * * * *